US005582114A

United States Patent [19]

Feiner

[11] Patent Number: 5,582,114

[45] Date of Patent: Dec. 10, 1996

[54] TILTABLE PORTABLE PALLET

[75] Inventor: Gideon Feiner, Braaschaat, Belgium

[73] Assignee: GE Polymer Logistics, Bergen, Netherlands

[21] Appl. No.: 560,056

[22] Filed: Nov. 17, 1995

[51] Int. Cl.[6] ..... B65D 19/00

[52] U.S. Cl. ..... 108/51.1; 280/28.5; 280/304.5; 280/63

[58] Field of Search ..... 108/51.1, 52.1; 280/28.5, 47.15, 47.2, 63, 292, 304.5, 414.2

[56] References Cited

U.S. PATENT DOCUMENTS 4,611,816 9/1986 Traister ..... 280/43.2
4,976,448 12/1990 Wickersham et al. ..... 280/47.2 R

FOREIGN PATENT DOCUMENTS 0242376 1/1963 Australia ..... 108/51.1
0859186 1/1961 United Kingdom ..... 108/51.1
0901340 7/1962 United Kingdom ..... 108/51.1

*Primary Examiner*—James R. Brittain
*Assistant Examiner*—Gerald A. Anderson
*Attorney, Agent, or Firm*—Mark M. Friedman

[57] ABSTRACT

A pallet capable, when supporting a load, of being alternately lifted and transported by a forklift having prongs or manually rolled across a floor. The pallet includes interconnected upper and lower planar members which form a pallet assembly featuring recesses for accommodating the prongs of the forklift. The pallet assembly further includes a mechanism for connecting a handle assembly near one end of the pallet assembly. The pallet assembly farther includes a pair of wheels mounted near the opposite end of the pallet assembly. The wheels are mounted so that when the pallet assembly lies horizontally on the floor the weight of the pallet is largely supported by the lower planar member while when the pallet is tilted so that the end away from the wheels is lifted the pallet is supported by the wheels so that the pallet and its load can be readily manually rolled on the floor.

8 Claims, 2 Drawing Sheets

FIG.1A
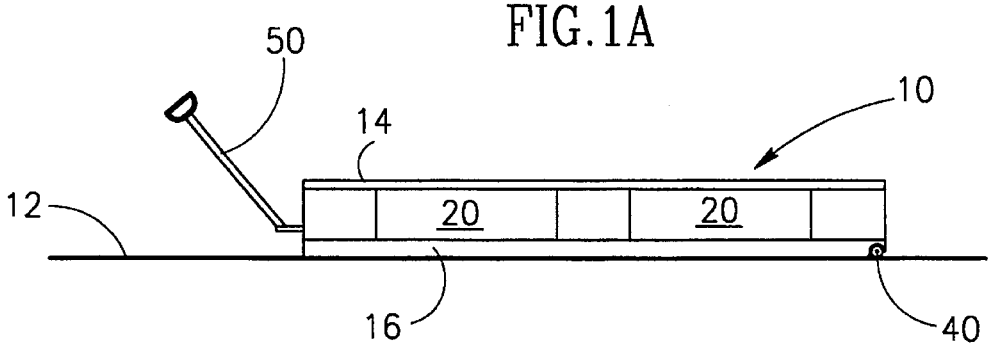
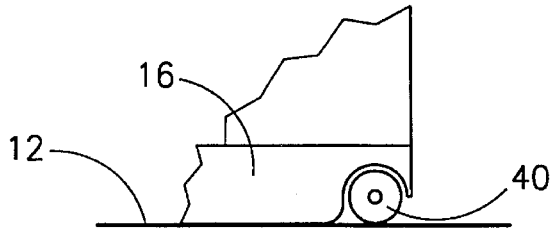
FIG.1B
FIG.2A
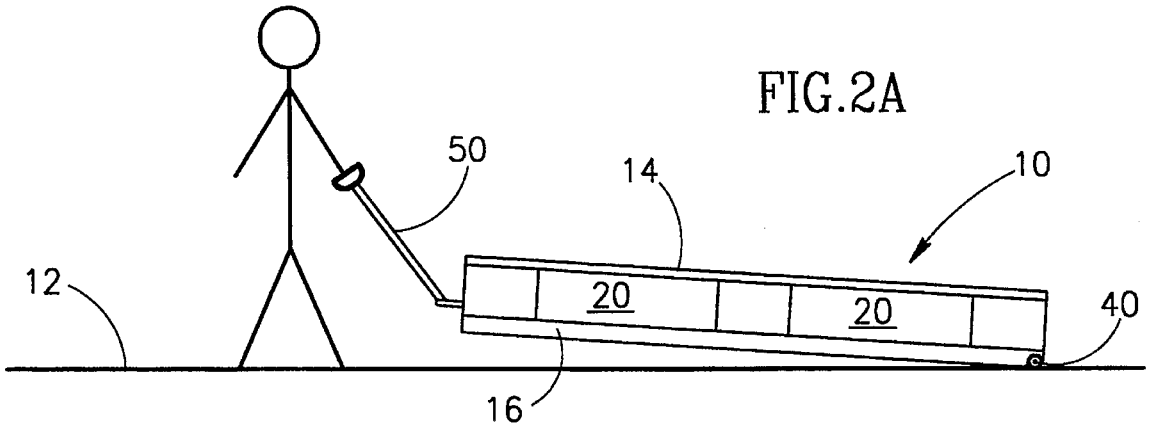
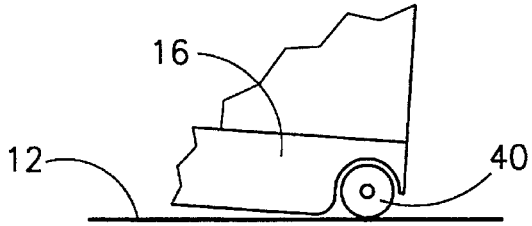
FIG.2B

FIG.3A
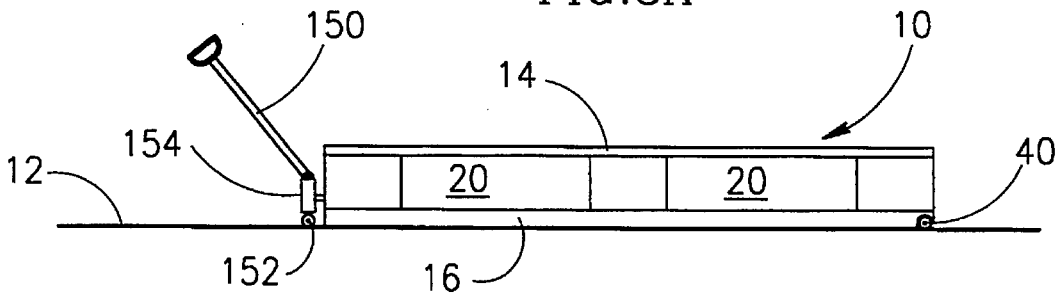
FIG.3B
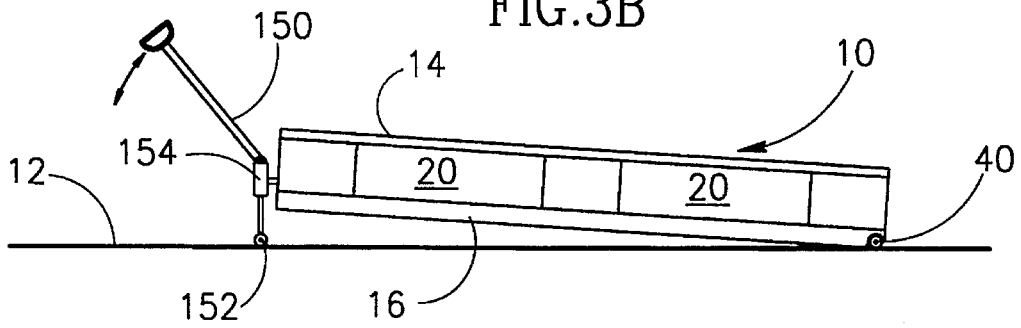
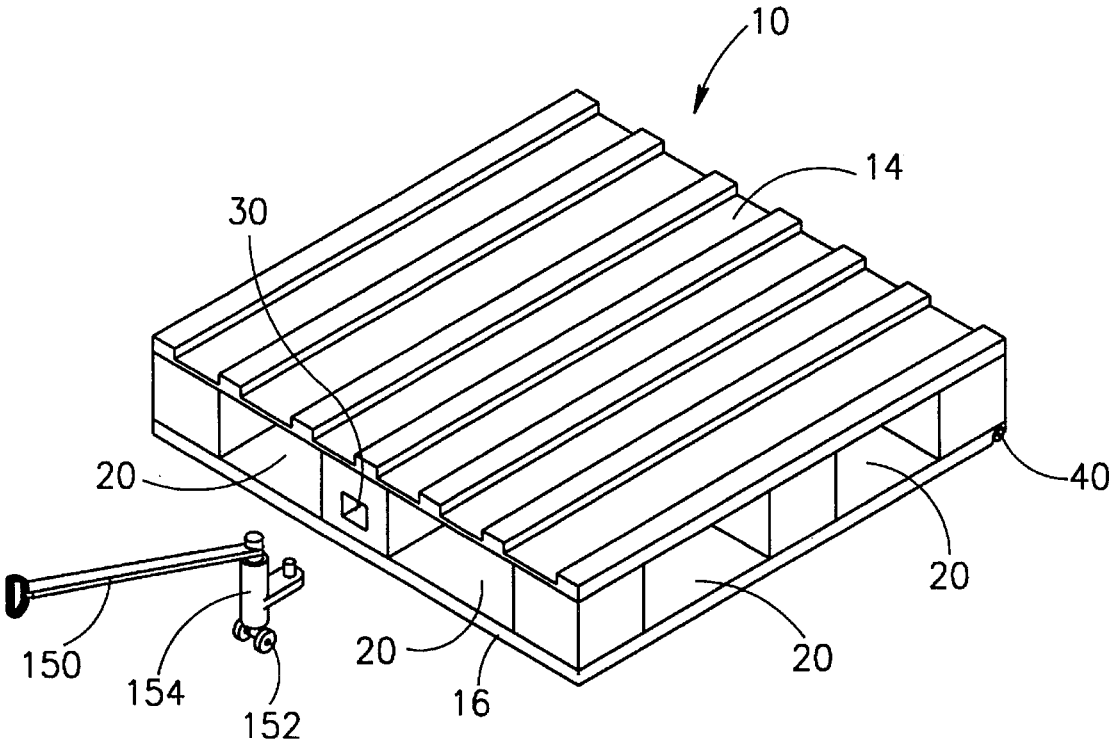
FIG.4

TILTABLE PORTABLE PALLET

FIELD AND BACKGROUND OF THE INVENTION

The present invention relates to pallets and, more particularly, to pallets which can be readily transported over short distances without the need for a forklift.

Pallets are commonly used to support various loads and makes it possible to transport loads of various sizes and shapes without damaging the load and using conventional transporting equipment, primarily forklifts of various types. A typical pallet is made of two substantially parallel planar members which are connected to each other using various cross-members, and the like, which are located so as to provide recesses between the two surfaces for accommodating the prongs of a forklift. The load rests on the outer surface of one of the planar members while the pallet rests on the floor so that the floor in contact with the outer surface of the other planar member. A forklift is then able to approach the loaded pallet, insert its prongs into the gaps between the two planar member and lift the pallet and load off the floor. The forklift can then be used to transport and deliver the load to another location.

While transporting the load using a forklift is, in most situations, very convenient and commonly practiced, there are situations where it is inconvenient or even impossible to use a forklift. For example, there are situations where a load supported by a pallet needs to be unloaded in relatively small quantities over a relatively small area. To take just one example, a load of groceries may need to be placed in a number of locations in a large supermarket. Use of a forklift in this situation may endanger the safety of the customers or force the operations to take place at times when the public is barred from the store. Furthermore, use of a forklift in this situation would require the forklift to stand by and from time to time move the load over small distances—an inefficient use of a forklift and its operator.

One partial solution is the use of a manual forklift which is hand-operated. However, such devices are generally rather large and complex and are rather cumbersome to get around in tight quaffers, such as the aisles of a supermarket, and the like.

There is thus a widely recognized need for, and it would be highly advantageous to have, a pallet for supporting a load which, in addition to being transportable when loaded by a forklift in the conventional manner, would also be movable when loaded over relatively small distances without the use of a driven or a manual forklift simply by manually pulling or pushing the pallet over the floor.

SUMMARY OF THE INVENTION

According to the present invention there is provided a pallet capable, when supporting a load, of being alternately lifted and transported by a forklift having prongs or manually rolled across a floor, comprising: (a) an upper planar member; (b) a lower planar member connected to, or integrally formed with, the upper planar member to form a pallet assembly having a first end and a second end, the pallet assembly featuring recesses for accommodating the prongs of the forklift; (c) means for detachably connecting a handle assembly near the first end of the pallet assembly; and (d) at least two wheels mounted near the second end of the pallet assembly, the wheels being mounted so that the pallet is substantially supported on the lower planar member when the pallet assembly lies horizontally on the floor while the pallet is substantially supported by the at least two wheels when the pallet assembly is tilted so that the first end of the pallet assembly is lifted above the second end of the pallet assembly.

According to further features in preferred embodiments of the invention described below, the means for detachably connecting a handle is recessed into the pallet assembly.

Also according to the present invention, there is provided a pallet assembly capable, when supporting a load, of being alternately lifted and transported by a forklift having prongs or manually rolled across a floor, comprising: (a) an upper planar member; (b) a lower planar member connected to, or integrally formed with, the upper planar member to form a pallet assembly having a first end and a second end, the pallet assembly featuring recesses for accommodating the prongs of the forklift; (c) means for detachably connecting a handle assembly near the first end of the pallet assembly; (d) a handle assembly for connecting to the means for detachably connecting; and (e) at least two wheels mounted near the second end of the pallet assembly, the wheels being mounted so that the pallet is substantially supported on the lower planar member when the pallet assembly lies horizontally on the floor while the pallet is substantially supported by the at least two wheels when the pallet assembly is tilted so that the first end of the pallet assembly is lifted above the second end of the pallet assembly.

According to still further features in the described preferred embodiments, the handle assembly includes a wheel assembly and further includes means for downwardly extending the wheel assembly, the wheel assembly being mounted so that the pallet is substantially supported on the lower planar member when the pallet assembly lies horizontally on the floor while the pallet is substantially jointly supported by the at least two wheels and by the wheel assembly when the pallet assembly is tilted through downward extension of the wheel assembly so that the first end of the pallet assembly is lifted above the second end of the pallet assembly.

The present invention successfully addresses the shortcomings of the presently known configurations by providing a pallet which can be manually transported over relatively short distances simply by tilting the pallet slightly. The tilting can be effected by inserting a simple detachable handle into one end of the pallet assembly and lifting up so that one end of the pallet assembly lifts up slightly. Alternatively, the tilting can be effected by inserting a detachable handle assembly which features a wheel assembly which can be extended downward, for example, using a built-in jack mechanism, so as to bring about the desired tilt. Once the tilt has been effected, the pallet can be readily rolled over the floor.

BRIEF DESCRIPTION OF THE DRAWINGS

The invention is herein described, by way of example only, with reference to the accompanying drawings, wherein:

FIG. 1A is a side view of a pallet according to the present invention when resting on the floor;

FIG. 1B is a blow up of a portion of the pallet of FIG. 1 showing the wheel section;

FIG. 2A shows the pallet of FIG. 1A as it would appear during manual short-distance transport;

FIG. 2B is a blow up of a portion of the pallet of FIG. 2A showing the wheel section;

FIG. 3A is a side view of a another configuration of a pallet according to the present invention featuring a vertically displaceable front wheel assembly showing the pallet resting on the floor;

FIG. 3B shows the pallet of FIG. 3A as it would appear during manual short-distance transport;

FIG. 4 is a perspective view of a pallet as in FIGS. 3A and 3B.

DESCRIPTION OF THE PREFERRED EMBODIMENTS

The present invention is of a tillable portable pallet which can be used as a regular pallet and which can, in addition, be manually moved over short distances, even when carrying a load, without requiring the use of a forklift.

The principles and operation of a pallet according to the present invention may be better understood with reference to the drawings and the accompanying description.

Referring now to the drawings, FIG. 1A, 1B, 2A and 2B illustrate a first embodiment of a tiltable portable pallet 10 according to the present invention, which is capable, when supporting a load, of being alternately lifted and transported by a forklift having prongs or manually rolled across a floor 12. Pallet 10 is made up of an upper planar member 14 and a lower planar member 16. Upper planar member 14 and lower planar member 16 are connected to, or integrally formed with, each other to form a pallet assembly which features recesses 20 for accommodating the prongs of the forklift (not shown). Preferably, recesses 20 extend in two substantially mutually perpendicular directions (FIG. 4) so that pallet 10 can be lifted by a forklift from any of its four sides.

A pallet according to the present invention further includes means for detachably connecting a handle assembly near one end of the pallet assembly. Any suitable means may be envisioned and many such mechanisms are in widespread use in a variety of applications. The means for detachably connecting the handle assembly (50) is connected to the pallet assembly and is preferably found in a recess 30 (FIG. 4) of the pallet assembly so that no portion of the means extends beyond the conventional outline of the pallet, thereby making it possible to readily transport and stack unloaded pallets of the present invention in the same way that conventional pallets are transported and stacked.

A pallet according to the present invention further includes at least a pair of wheels 40 which are mounted onto the end of the pallet assembly opposite the end which includes the means for connecting the handle assembly. Preferably, wheels 40 are mounted so that at least one wheel is mounted near a comer of the end of the pallet assembly.

Wheels 40 are mounted in such a way that when the pallet assembly lies horizontally on floor 12 (FIG. 1A) the weight of pallet 10 is substantially supported on lower planar member 16. In this position, wheels 40 may just touch floor 12 (FIG. 1B) or there may be a small gap between the bottom of wheels 40 and floor 12 (not shown).

However, when the pallet assembly is tilted so that the end of the pallet assembly near handle assembly 50 is lifted above the opposite end of the pallet assembly (FIGS. 2A and 2B), the weight of the pallet assembly is substantially supported by wheels 40. With the weight of the pallet assembly resting on wheels 40, it is possible to push or pull the pallet assembly, with any load which may be found thereon, across the floor to a different location. Once the new location has been reached, the uplifted end of the pallet assembly is eased back to the floor so as to take the weight of the pallet assembly off the wheels and bring the assembly to rest in its new location.

In another embodiment of a pallet according to the present invention depicted in FIGS. 3A, 3B and 4, handle assembly 150 further includes a wheel assembly 152 and further includes means 154 for downwardly extending wheel assembly 152. Wheel assembly 152 is mounted so that the pallet is substantially supported on lower planar member 16 when the pallet assembly lies horizontally on floor 12 while the pallet assembly is substantially jointly supported by wheels 40 and by wheel assembly 152 when the pallet assembly is tilted through the downward extension of wheel assembly 152 so that the end of the pallet assembly adjoining handle assembly 150 is lifted above the opposing end of the pallet assembly.

Any suitable means 154 for downwardly extending wheel assembly 152 may be used. Preferably, means 154 is a suitable jack mechanism, not unlike the well-known mechanism commonly used to lift up a portion of a vehicle to facilitate the changing of a flat tire.

While the invention has been described with respect to a limited number of embodiments, it will be appreciated that many variations, modifications and other applications of the invention may be made.

What is claimed is:

1. A pallet capable, when supporting a load, of being alternately lifted and transported by a forklift having prongs or manually rolled across a floor, comprising:

(a) an upper planar member;

(b) a lower planar member connected to, or integrally formed with, said upper planar member to form a pallet assembly having a first end and a second end, said pallet assembly featuring recesses for accommodating the prongs of the forklift;

(c) means for detachably connecting a handle assembly near said first end of said pallet assembly; and (d) at least two wheels mounted near said second end of said pallet assembly, said wheels being mounted so that the pallet is substantially supported on said lower planar member when said pallet assembly lies horizontally on the floor while the pallet is substantially supported by said at least two wheels when said pallet assembly is tilted so that said first end of said pallet assembly is lifted above said second end of said pallet assembly.

2. The pallet of claim 1, wherein said means for detachably connecting a handle is recessed into said pallet assembly.

3. The pallet of claim 1, wherein said at least two wheels are mounted onto said lower planar member near ends of said lower planar member.

4. A pallet assembly capable, when supporting a load, of being alternately lifted and transported by a forklift having prongs or manually rolled across a floor, comprising:

(a) an upper planar member;

(b) a lower planar member connected to, or integrally formed with, said upper planar member to form a pallet assembly having a first end and a second end, said pallet assembly featuring recesses for accommodating the prongs of the forklift;

(c) means for detachably connecting a handle assembly near said first end of said pallet assembly;

(d) a handle assembly for connecting to said means for detachably connecting; and (e) at least two wheels mounted near said second end of said pallet assembly, said wheels being mounted so that the pallet is substantially supported on said lower planar member when said pallet assembly lies horizontally on the floor while the pallet is substantially supported by said at least two wheels when said pallet assembly is tilted so that said first end of said pallet assembly is lifted above said second end of said pallet assembly.

5. The pallet assembly of claim 4, wherein said means for detachably connecting a handle is recessed into said pallet assembly.

6. The pallet assembly of claim 4, wherein said at least two wheels are mounted onto said lower planar member near ends of said lower planar member.

7. The pallet assembly of claim 4, wherein said handle assembly includes a wheel assembly and further includes means for downwardly extending said wheel assembly, said wheel assembly being mounted so that the pallet is substantially supported on said lower planar member when said pallet assembly lies horizontally on the floor while the pallet is substantially jointly supported by said at least two wheels and by said wheel assembly when said pallet assembly is tilted through downward extension of said wheel assembly so that said first end of said pallet assembly is lifted above said second end of said pallet assembly.

8. The pallet assembly of claim 7, wherein said means for downwardly extending said wheel assembly is a jack mechanism.

* * * * *